US007410381B2

(12) United States Patent
Tang et al.

(10) Patent No.: US 7,410,381 B2
(45) Date of Patent: Aug. 12, 2008

(54) CONNECTOR FOR CONNECTING TO A SIGNAL LINE

(75) Inventors: Zheng-Yong Tang, Jiangsu Province (CN); Zhi-Huang Lian, Taipei County (TW)

(73) Assignee: Qisda Corporation, Taoyuan County (TW)

( * ) Notice: Subject to any disclaimer, the term of this patent is extended or adjusted under 35 U.S.C. 154(b) by 0 days.

(21) Appl. No.: 11/426,330

(22) Filed: Jun. 26, 2006

(65) Prior Publication Data

US 2007/0004266 A1 Jan. 4, 2007

(30) Foreign Application Priority Data

Jun. 30, 2005 (TW) ..... 94122186 A

(51) Int. Cl.
*H01R 13/62* (2006.01)

(52) U.S. Cl. ..... 439/260

(58) Field of Classification Search ..... 439/260, 439/489, 142, 488, 357–358
See application file for complete search history.

(56) References Cited

U.S. PATENT DOCUMENTS

2004/0161965 A1* 8/2004 Bricaud et al. ..... 439/489
2006/0035515 A1* 2/2006 Pabst ..... 439/492

* cited by examiner

*Primary Examiner*—Jean F Duverne

(57) ABSTRACT

A connector, fixed on a circuit board for connecting to a signal line includes a base plate, a base body, a cover part and an elastic component. The base body is fixed on the base plate A circuit-board signal line at a bottom end of the base body is electrically coupled to the circuit board. The cover part, connected to the base body, can be opened or closed relative to the base body. The elastic component is for storing an elastic restoring force for engaging the cover part with the base body. By closing the cover part relative to the base body, the connector fixes the signal line in the base body such that the signal line is electrically coupled to the circuit-board signal line. When the cover part is opened relative to the base body, the signal line can be departed from the connector.

11 Claims, 7 Drawing Sheets

CONNECTOR FOR CONNECTING TO A SIGNAL LINE

This application claims the benefit of Taiwan application Serial No. 94122186, filed on Jun. 30, 2005, the subject matter of which is incorporated herein by reference.

BACKGROUND OF THE INVENTION

1. Field of the Invention

The invention relates in general to a connector, and more particularly to a connector for connecting a signal line to a circuit board.

2. Description of the Related Art

Signal lines are widely applied to various electronic products, such as for transmitting signals between a motherboard and a disk drive of a computer, or between a main board and a chassis of a scanner. A variety of electronic products perform signal transmission via signal lines.

Referring to FIG. 1, a solid view of a conventional circuit board and a connector thereon is shown. The signal line 102, such as a soft flexible flat cable, for inserting to a connector of a circuit board, such as one of the connectors 104*a*, 104*b* and 104*c*. The signal line 102 has a number of pins while one of the connector 104*a*~104*c* has correspondingly a number of sockets for the pins to be inserted in. However, in the process when the user inserts the signal line 102, the pins of the signal line 102 are often broken, wound or deformed due to inserting or pulling the signal line 102 by unsuitable forces.

Besides, the connector 104*a* is disposed by laying on the circuit board with all the pins therein orientated horizontally. As the signal line 102 is to be inserted by the user, it will be uneasy to insert the signal line 102 due to the insufficient space in between the connector 104*a* and other components on the circuit board.

SUMMARY OF THE INVENTION

It is therefore an object of the invention to provide a connector. The signal line can be easily inserted to the connector or pulled out of the connector without pin winding or distortion issue as occurred in a prior-art connector. In the meanwhile, enough positioning space is provided for the user to insert the signal line to the connector or pull the signal line out of the connector conveniently.

The invention achieves the above-identified object by providing a connector. The connector is fixed to a circuit board for connecting to a signal line. The connector includes a base plate, a base body, a cover part and an elastic component. The base plate is disposed on the circuit board. The base body is fixed to the base plate. A circuit-board signal line at a bottom end of the base body is electrically coupled to the circuit board. The cover part is connected to the base body and capable of being opened or closed relative to the base body. The elastic component is for storing an elastic restoring force for engaging the cover part with the base body. By closing the cover part relative to the base body, the connector fixes the signal line in the base body such that the signal line is electrically coupled to the circuit-board signal line. When the cover part is opened relative to the base body, the signal line can be departed from the connector.

Other objects, features, and advantages of the invention will become apparent from the following detailed description of the preferred but non-limiting embodiments. The following description is made with reference to the accompanying drawings.

DETAILED DESCRIPTION OF THE INVENTION

Embodiment One

Figure 1:
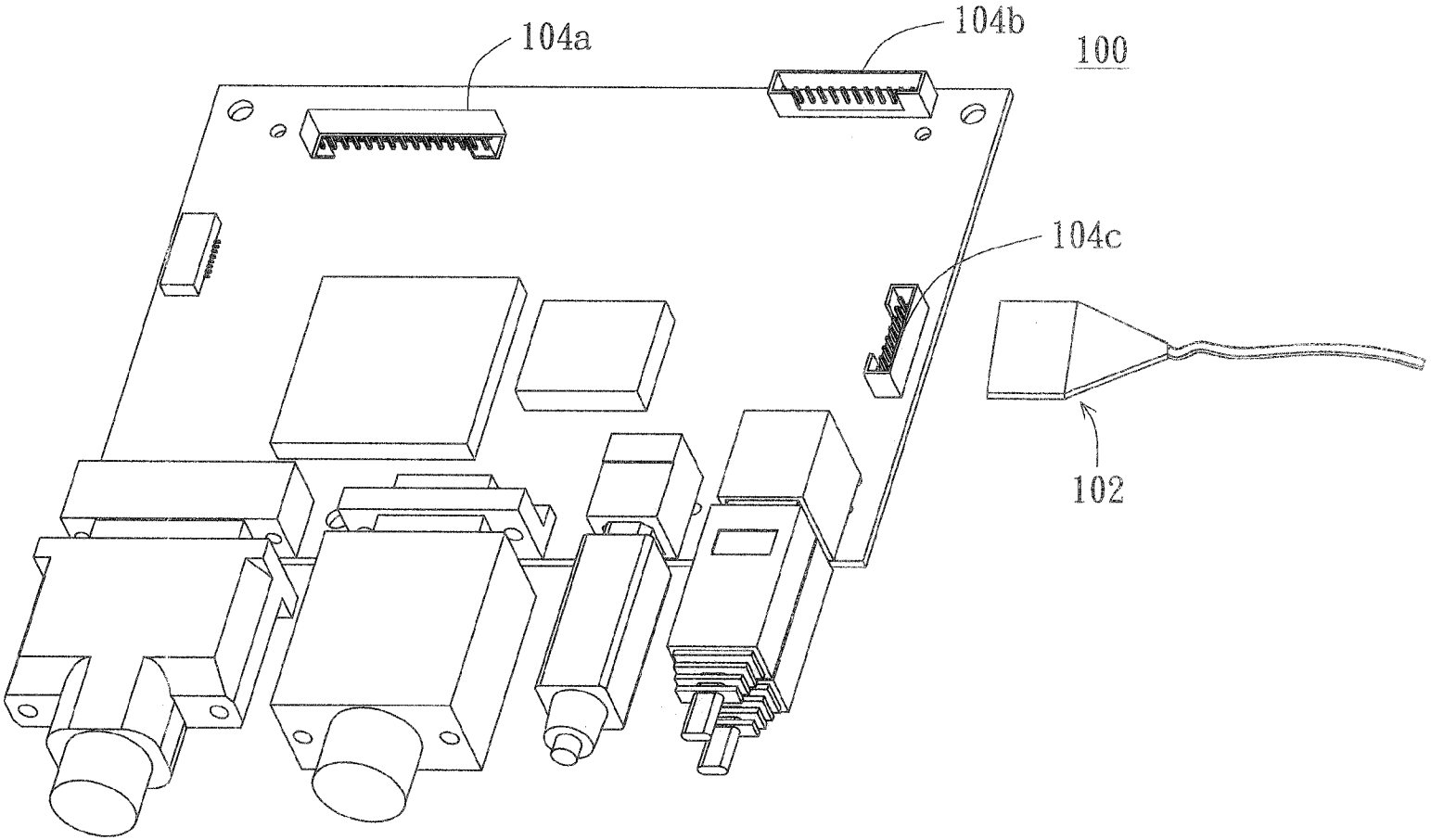
FIG. 1(PRIOR ART)
FIG. 1 is a solid view of a conventional circuit board and a connector thereon.
Figure 2A:
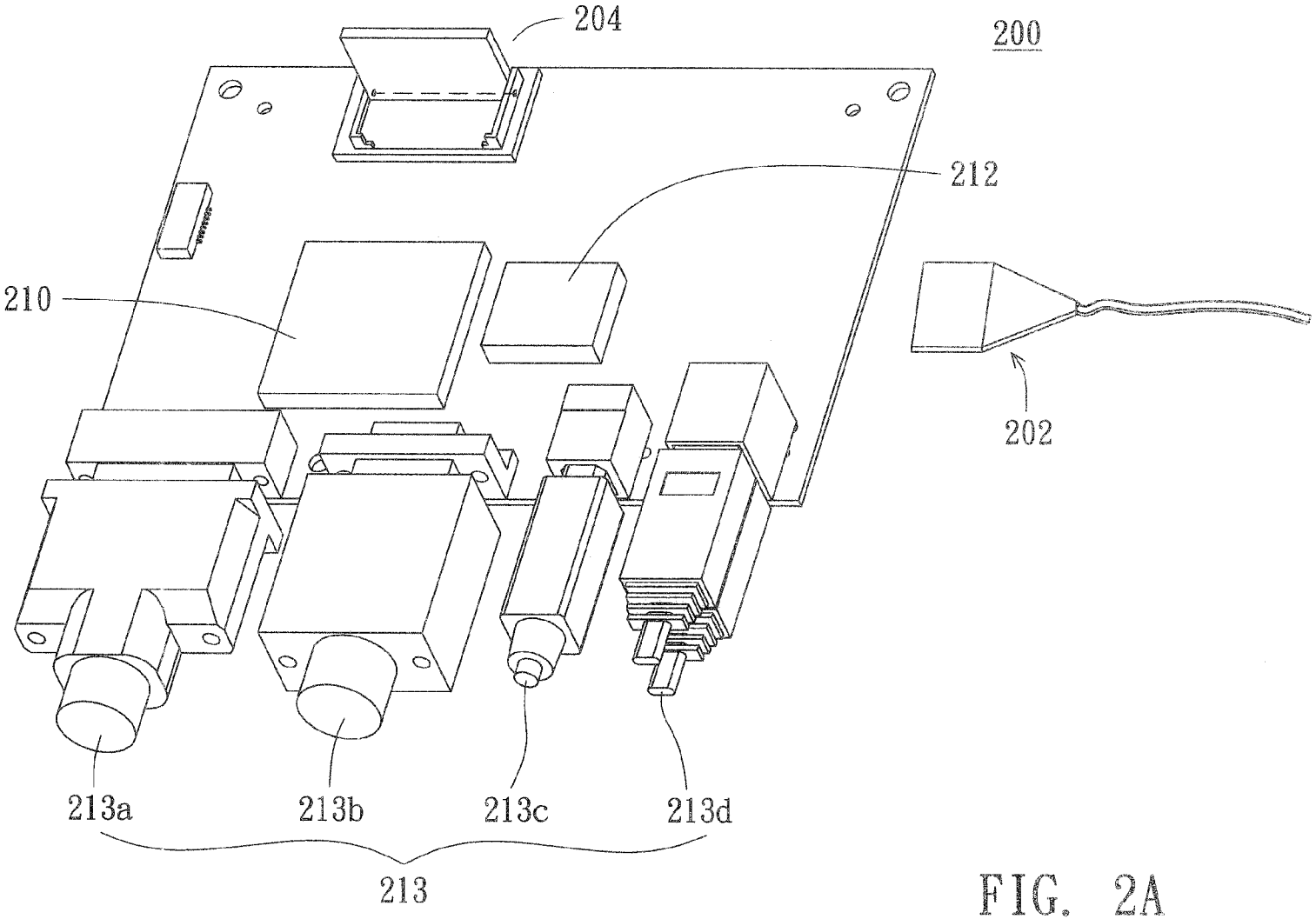
FIG. 2A is a solid view of a circuit board according to the first embodiment of the invention.

Referring to FIG. 2A, a solid view of a circuit board according to the first embodiment of the invention is shown. In the first embodiment, the circuit board 200 has a number of electronic components, such as the electronic components 210 and 212. The circuit board 200 further includes a number of connectors 213*a*~213*d* for electrically coupling to the exterior. The signal line 202 is for transmitting signals to the interior or the exterior of the circuit board 200 by inserting to the connector 204.

Figure 2B:
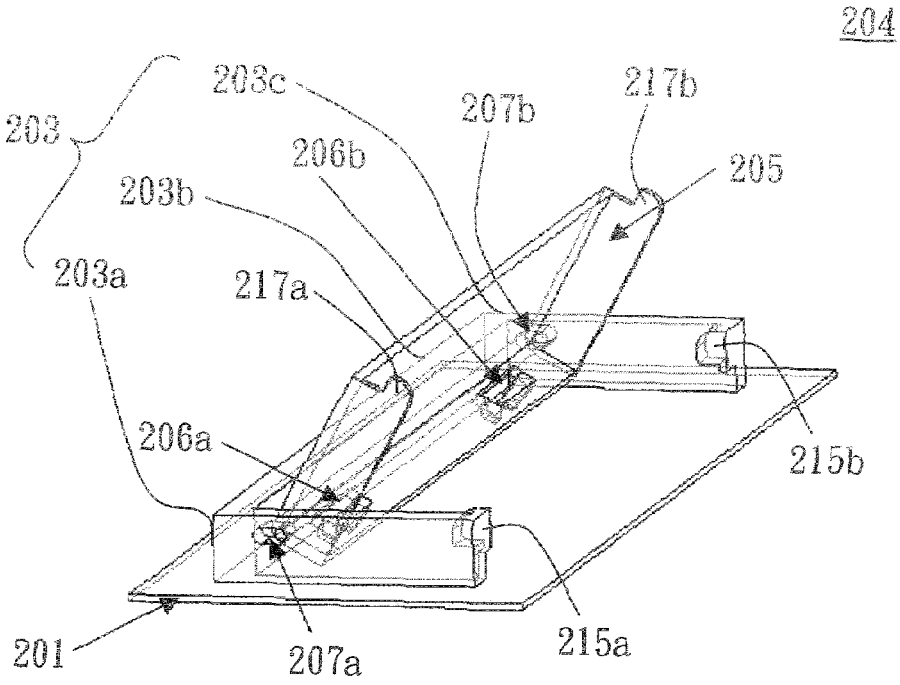
FIG. 2B is a solid view of the connector in FIG. 2A.
Figure 2C:
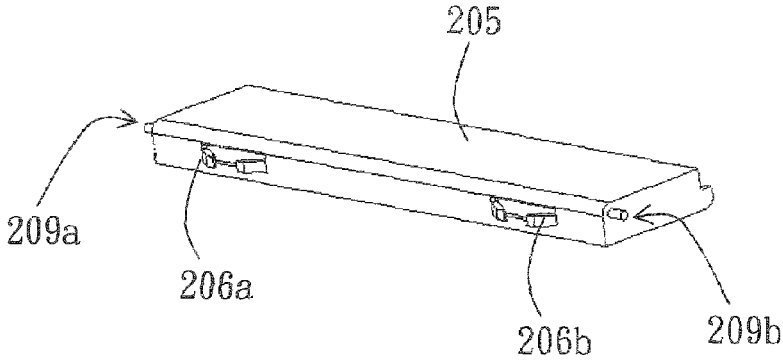
FIG. 2C is a schematic diagram of a cover part of the connector in FIG. 2A.
Figure 2D:
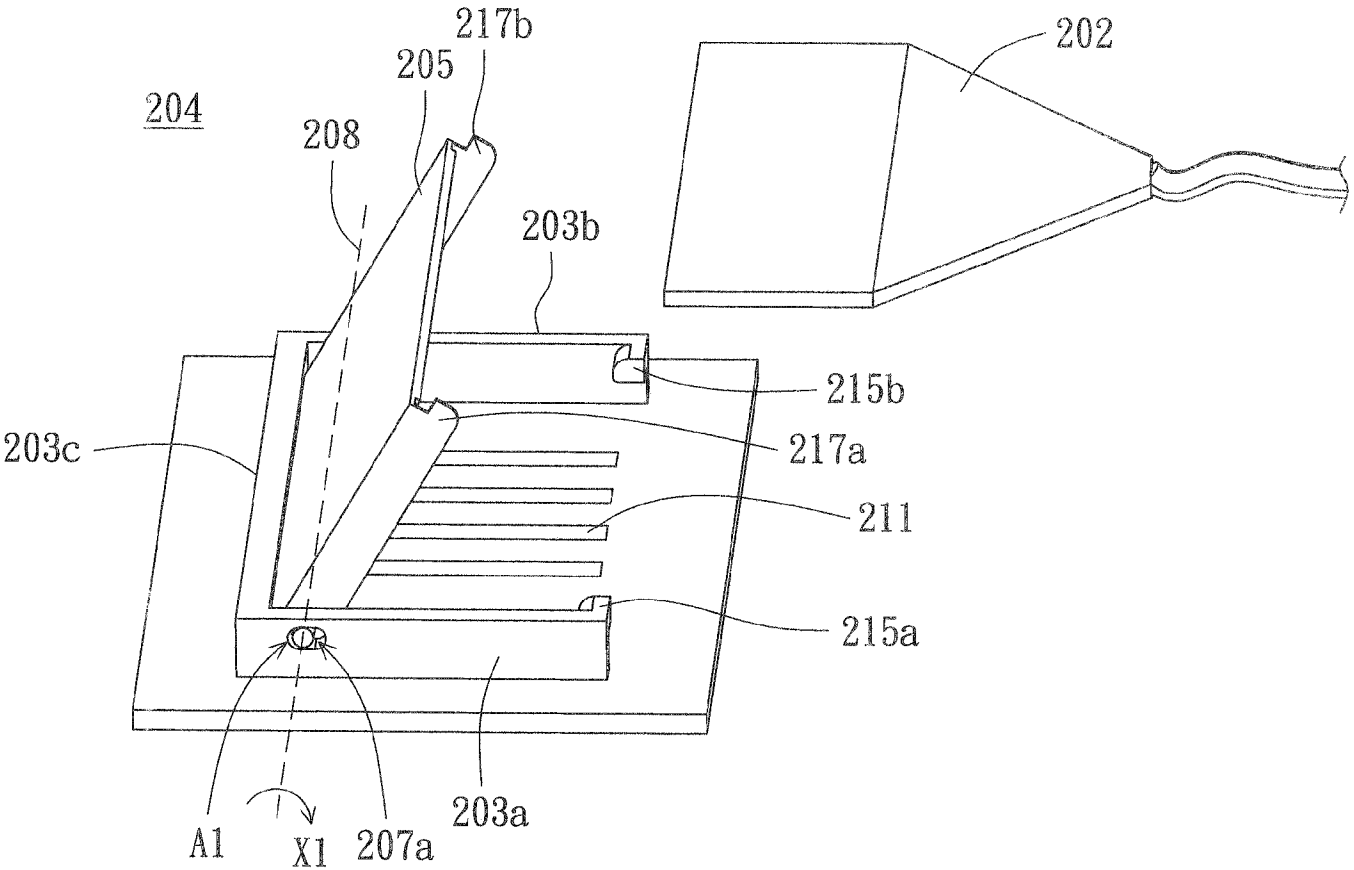
FIG. 2D is a schematic diagram of the connector and the signal line before the later is inserted to the former in FIG. 2A.

Referring to FIG. 2B, FIG. 2C and FIG. 2D, FIG. 2B shows a solid view of the connector 204, FIG. 2C shows a schematic diagram of a cover part of the connector 204, while FIG. 2D shows a schematic diagram of the connector 204 and the signal line 202 before the later is inserted to the former. The connector 204 includes a base plate 201, a base body 203, and a cover part 205. The base plate 201 is for fixing to the circuit board 201, and the cover part 205 is connected to the base body 203 such that the cover part 205 can be opened or closed relative to the base body 203 and the base plate 201. The base body 203 has a first side plate 203*a*, a second side plate 203*b*, and a third side plate 203*c*. The first side plate 203*a* and the second side plate 203*b* are disposed at two sides of the base plate 201 while the third side plate 203*c* is connected to the first side plate 203*a* and the second side plate 203*b*. The first side plate 203*a* has a first opening 207*a* whereas the second side plate 203*b* has a second opening 207*b*. A connection line between a first positioning part 209*a* and a second positioning part 209*b* of the cover part 205 is defined as a positioning axis 208. The positioning axis 208 is movably positioned in the first opening 207*a* and the second opening 207*b*.

As shown in FIG. 2C, two elastic components 206*a* and 206*b*, such as springs or elastic arms, are disposed at one side of the cover part 205. The first side plate 203*a* of the base body 203 has a first fixing part 215*a*, the second side plate 203*b* has a second fixing part 215*b*, while the cover part 205 has respectively a first engaging part 217*a* and a second engaging part 217*b* at each side. The first engaging part 217*a* and the second engaging part 217*b* are respectively configured corresponding to the first fixing part 215*a* and the second fixing part 215*b*. It is needed only that the first engaging part 217*a* and the second engaging part 217*b* have respectively the shapes, such as an arc-shape in the embodiment, corresponding to those of the first fixing part 215*a* and the second fixing part 215*b*.

Before the signal line 202 is inserted to the connector 204, the cover part 205 is opened relative to the base plate 201, and the positioning axis 208 of the cover part 205 is located at a position A1 in the first opening 207*a*. At the time, the elastic components 206*a* and 206*b* are pressed to the third side plate 203*c* of the base body 203 to store up an elastic restoring force. When the signal line 202 is inserted to the connector 204 properly, the user rotates the cover part 205 relative to the positioning axis 208 along a direction X1 to close the cover part 205 onto the base plate 201.

Figure 2E:
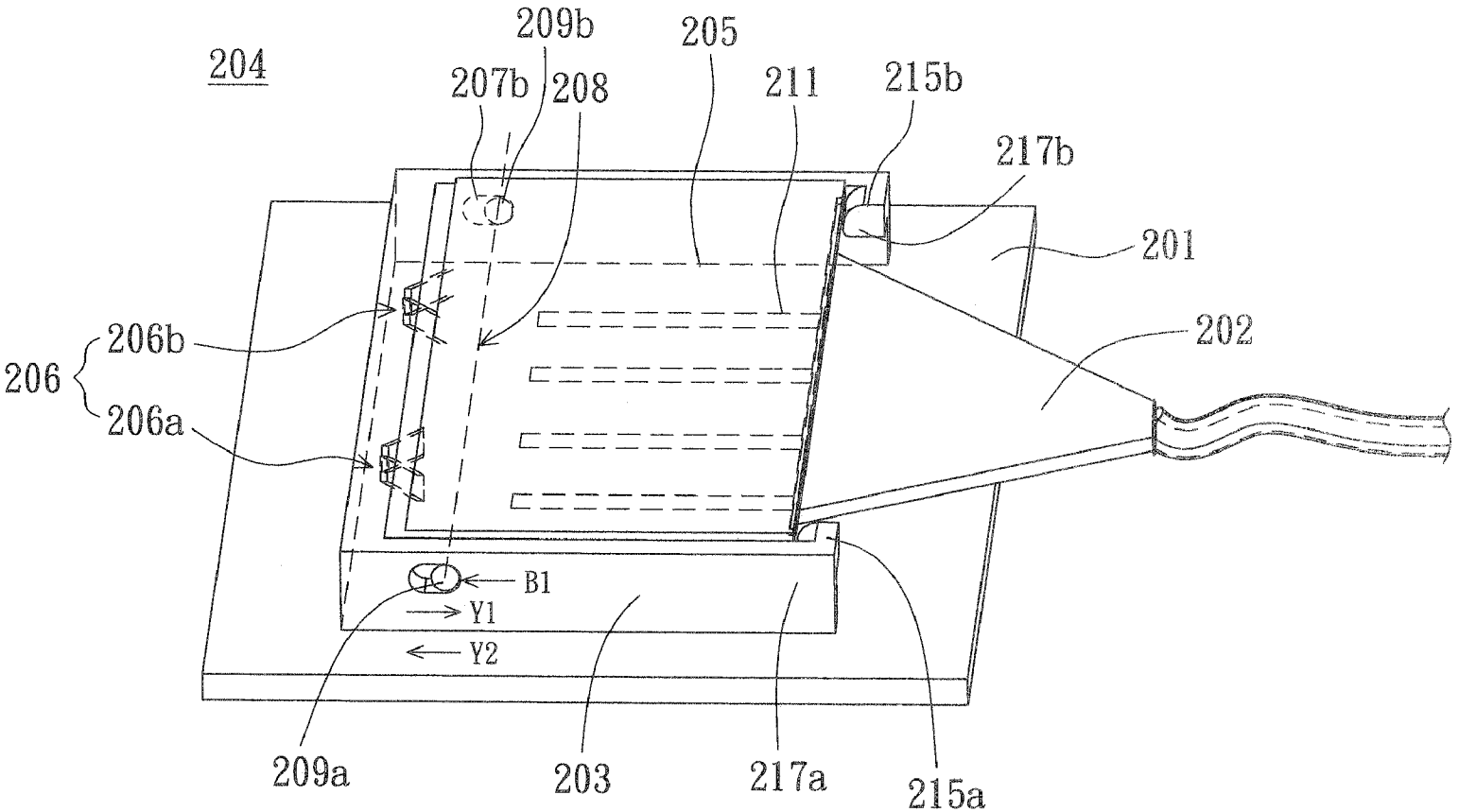
FIG. 2E is a schematic diagram of the connector inserted by the signal line in FIG. 2A.

Referring to FIG. 2E, a schematic diagram of the connector 204 inserted by the signal line 202 is shown. When the user closes the cover part 205 onto the base plate 201, the elastic force stored in the elastic components 206*a* and 206*b* drives the positioning axis 208 as well as the whole cover part 205 to move along a direction Y1 until the first engaging part 217*a* and the second engaging part 217*b* of the cover part 205 respectively engage with the first fixing part 215*a* and the second fixing part 215*b* of the base body 203. At the time, the positioning axis 208 is located at a position B1 in the first opening 207*a*. Therefore, the purpose of fixing the signal line 202 to the connector 204 can be achieved, and the signal line 211 of the circuit board 200 can be firmly and electrically coupled to the signal line 202 for transmitting signals via the bottom end of the base body 203 as the cover part 205 is closed relative to the base plate 201 Owing that the signal line 202 is configured horizontally, the pins of the signal line 202 will not be bruised or wound.

If the user would like to open the cover part 205 again to take out the signal line 202, the user has only to push the cover part 205 along the direction Y2 to overcome the elastic force applied by the elastic components 206*a* and 206*b* and then rotates the cover part 205 to take out the signal line 202. That is, in addition that the positioning axis 208 formed by the first positioning part 209*a* and the second positioning part 209*b* can be used for an axis of cover part rotation, the positioning axis 208 can also slide in the first opening 207*a* and the second opening 207*b*. The sliding distance of the positioning axis 208 is substantially the distance by which the elastic components 206*a* and 206*b* are elongated or compressed.

Embodiment Two

Figure 3:
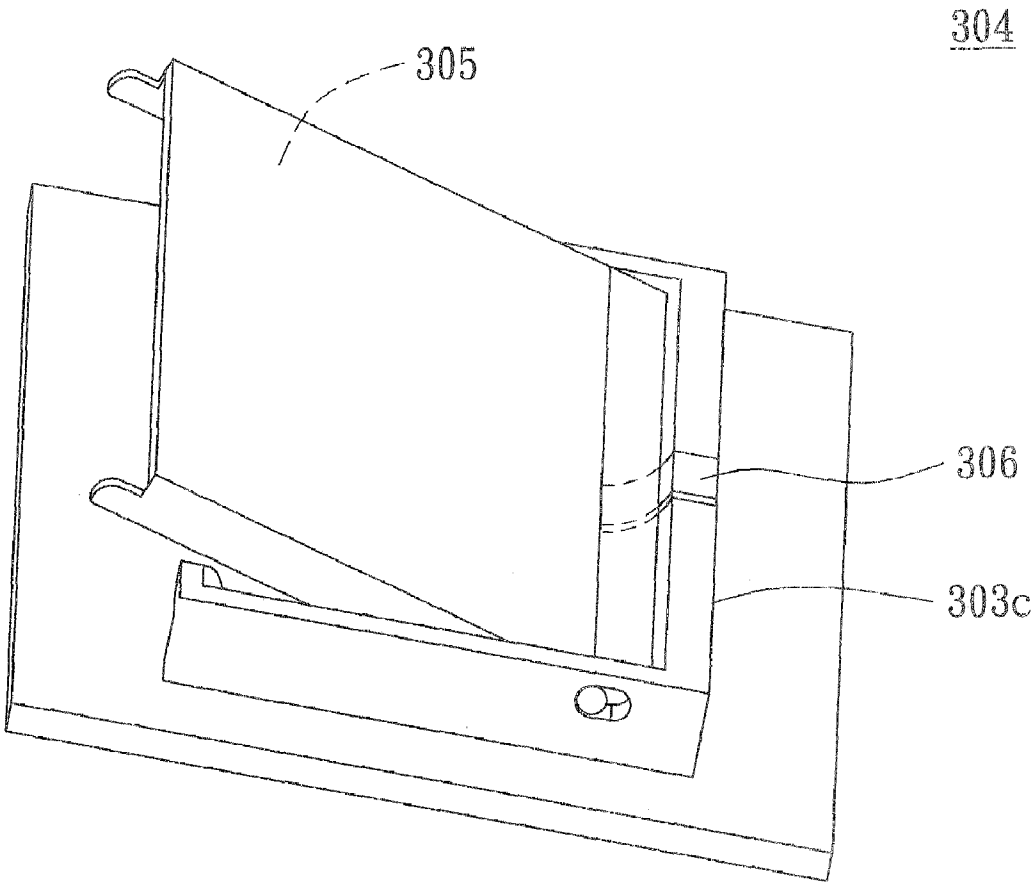
FIG. 3 is a solid view of the connector according to the second embodiment of the invention.

Referring to FIG. 3, a solid view of the connector according to the second embodiment of the invention is shown. Different from the first embodiment in which the elastic components are disposed on the cover part, in the second embodiment, the elastic component 306 of the connector 304 is disposed on the third side plate 303*c* of the base body. When the cover part 305 compresses the elastic component 306 of the third side plate 303*c* to store an elastic restoring force, the elastic restoring force can be used for engaging the cover part 305 with the signal line (not shown in the figure). Of course, the number of the elastic components 306 is not limited to only one. The number of the elastic components can be determined according to the required force for engaging the signal line with the connector and the elastic coefficient of the elastic component in the embodiment, a leaf spring is used as the elastic component. However, the same purpose can be achieved by using a spring, a twisted spring or an elastic arm.

Figure 4:
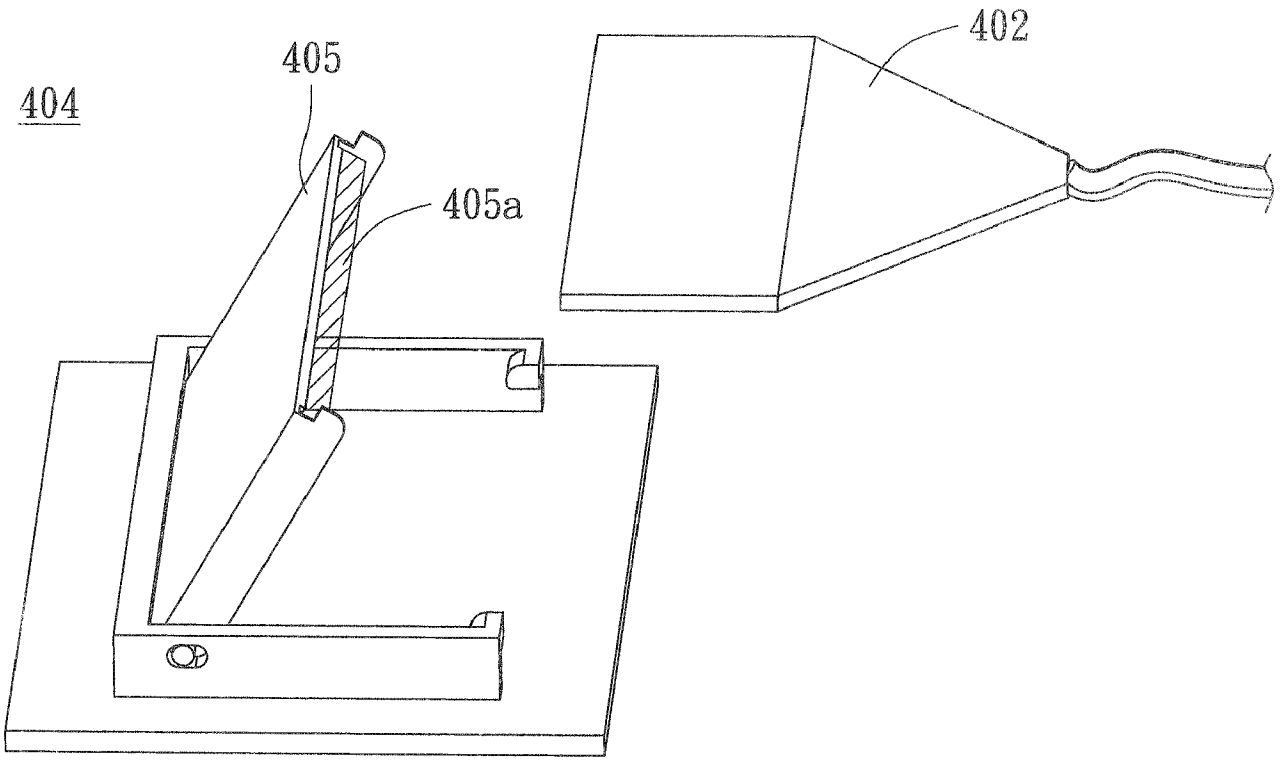
FIG. 4 is a solid view of a connector having a cover plate.

Referring to FIG. 4, a solid view of a connector having a front cover is shown. In the first and the second embodiments, in order that the connector 404 can properly contact and firmly engage with the signal line 402, a front cover 405*a* can be added to the cover part 405 to tightly contact and position the signal line 402. In the meanwhile, the transmission quality of the signal line 402 can be prevented from being reduced due to deformation of the cover part 405.

As fixing the signal line to the connector disclosed by the above embodiments of the invention, the user does not need to worry that the pins of the signal line will be broken or wound or there is insufficient space to insert the signal line to the connector. The signal line can be positioned firmly and easily by the force of the elastic component generated as the cover part is closed relative to the base plate.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A connector, fixed on a circuit board, for connecting to a signal line, the connector comprising:

a base plate, disposed on the circuit board;

a base body, fixed on the base plate, wherein a circuit-board signal line at a bottom end of the base body is electrically coupled to the circuit board;

a cover part, connected to the base body, and capable of being opened or closed relative to the base body, wherein the cover part comprises:

a first side plate, having a first fixing part at one end:

a second side plate, disposed corresponding to the first side plate, and having a second fixing part at one end; and a third side plate, connecting to the first side plate and the second side plate; and an elastic component, for storing an elastic restoring force and engaging the cover part with the base body, wherein the elastic component is disposed on the cover part;

wherein by closing the cover part relative to the base body, the connector fixes the signal line in the base body such that the signal line is electrically coupled to the circuit-board signal line;

wherein when the cover part is opened relative to the base body, the signal line is departed from the connector.

2. The connector according to claim 1, wherein the first side plate has a first opening, the second side plate has a second opening, and a positioning axis connecting a first positioning part and a second positioning part of the cover part is located between the first opening and the second opening for positioning and rotating the cover part.

3. The connector according to claim 2, wherein the first positioning part and the second positioning part can slide in the first opening and the second opening.

4. The connector according to claim 1, wherein the cover part comprises:

a first engaging part, corresponding to the first fixing part; and a second engaging part, corresponding to the second fixing part;

wherein when the cover part is closed relative to the base body, the first engaging part engages with the first fixing part and the second engaging part engages with the second fixing part.

5. The connector according to claim 4, wherein when the cover part is closed relative to the base body, the elastic component is pressed to the third side plate to store the elastic restoring force for tightly pressing the first engaging part and the second engaging part to the first fixing part and the second fixing part respectively.

6. The connector according to claim 1, wherein the cover part further comprises a front cover for contacting and pressing tightly against the signal line.

7. A connector, fixed on a circuit board, for connecting to a signal line, the connector comprising:

a base plate, disposed on the circuit board;

a base body, fixed on the base plate, wherein a circuit-board signal line at a bottom end of the base body is electrically coupled to the circuit board, wherein the base body comprises:

a first side plate, having a first fixing part at one end;

a second side plate, disposed corresponding to the first side plate, and having a second fixing part at one end; and a third side plate, connecting to the first side plate and the second side plate;

a cover part, connected to the base body, and capable of being opened or closed relative to the base body; and an elastic component, for storing an elastic restoring force and engaging the cover part with the base body, wherein the elastic component is disposed on the base body;

wherein by closing the cover part relative to the base body, the connector fixes the signal line in the base body such that the signal line is electrically coupled to the circuit-board signal line;

wherein when the cover part is opened relative to the base body, the signal line is departed from the connector.

8. The connector according to claim 7, wherein the first side plate has a first opening, the second side plate has a second opening, and a positioning axis connecting a first positioning part and a second positioning part of the cover part is located between the first opening and the second opening for positioning and rotating the cover part.

9. The connector according to claim 8, wherein the first positioning part and the second positioning part can slide in the first opening and the second opening.

10. The connector according to claim 7, wherein the cover part comprises:

a first engaging part, corresponding to the first fixing part; and a second engaging part, corresponding to the second fixing part;

wherein when the cover part is closed relative to the base body, the first engaging part engages with the first fixing part and the second engaging part engages with the second fixing part.

11. The connector according to claim 10, wherein the elastic component is disposed on the third side plate, and when the cover part is closed relative to the base body, the elastic component of the third side plate is compressed by the cover part to store the elastic restoring force for tightly pressing the first engaging part and the second engaging part to the first fixing part and the second fixing part respectively.

* * * * *